US008444502B2

(12) United States Patent
Karube

(10) Patent No.: US 8,444,502 B2
(45) Date of Patent: May 21, 2013

(54) SWINGWEIGHT

(76) Inventor: Nakaba Karube, Osaka (JP)

( * ) Notice: Subject to any disclaimer, the term of this patent is extended or adjusted under 35 U.S.C. 154(b) by 270 days.

(21) Appl. No.: 12/824,929

(22) Filed: Jun. 28, 2010

(65) Prior Publication Data

US 2011/0269565 A1 Nov. 3, 2011

(30) Foreign Application Priority Data

Apr. 30, 2010 (JP) ..... 2010-105299

(51) Int. Cl.
*A63B 53/16* (2006.01)

(52) U.S. Cl.
USPC ..... 473/297; 473/300

(58) Field of Classification Search
USPC ..... 473/293–299, 286, 300–303
See application file for complete search history.

(56) References Cited

U.S. PATENT DOCUMENTS 1,580,724 A * 4/1926 Harmon ..... 74/551.9
2,051,083 A * 8/1936 Hart ..... 473/297
3,606,327 A * 9/1971 Gorman ..... 473/297
4,600,195 A * 7/1986 Hunter ..... 473/297
5,452,891 A * 9/1995 Thomas ..... 473/294
5,465,967 A * 11/1995 Boeckenhaupt ..... 473/297
6,007,431 A * 12/1999 Bloom, Jr. ..... 473/292
7,544,134 B1 * 6/2009 Harmon et al. ..... 473/206
7,704,160 B2 * 4/2010 Lindner ..... 473/297
7,704,161 B2 * 4/2010 Lindner ..... 473/297
2012/0142444 A1 * 6/2012 Chol ..... 473/296

FOREIGN PATENT DOCUMENTS

JP 5-220242 A 8/1993
JP 3018130 U 8/1995
JP 2009-136641 A 6/2009

* cited by examiner

*Primary Examiner* — Stephen L. Blau
(74) *Attorney, Agent, or Firm* — Westerman, Hattori, Daniels & Adrian, LLP

(57) ABSTRACT

To provide a swingweight whose position of the center of gravity is appropriately fine-adjusted depending upon the situation, the swingweight of the present invention has a securing part, a support shaft and a weight, and is mounted to a grip end, and it is possible for the weight to be moved to any position in the axial direction of the support shaft and to be secured.

4 Claims, 6 Drawing Sheets

(a)

(b)

SWINGWEIGHT

TECHNICAL FIELD

The present invention relates to a swingweight used in a grip structure, such as a golf club.

BACKGROUND TECHNOLOGY

Conventionally, a golf club where a weight for swingweight adjustment is secured to a shaft or a grip using an inset or a screw has been provided, and specifically, for example, golf clubs having the swingweight disclosed in Patent Literature 1 to Patent Literature 3 have been provided.

In the golf club disclosed in Patent Literature 1, a vicinity of centroid is absent in the club head of the golf club, and the golf club has a configuration where a weight having an axis line in the direction intersecting to the axis line of the grip from the end of the grip side of the golf club where the vicinity of centroid of the golf club is absent is mounted.

Further, in the golf club disclosed in Patent Literature 2, a weight for swingweight adjustment is mounted to a hosel established for mounting a club head and a shaft by adhesion. The weight adopted herein is configured to have a cylindrical body and a flanged portion, and the weight is secured at a position at the end side (at the club head side) of the shaft by inserting the body into the shaft; concurrently, by tucking the flanged portion between the end of the shaft and the bottom surface of the hosel.

In addition, the golf club disclosed in Patent Literature 3 has a configuration where many spherical weight materials functioning as a weight for swingweight adjustment can be housed in a section placed within the grip, and the swingweight can be adjusted by adjusting the number of the weight materials.

PRIOR ART LITERATURE

Patent Literature

[Patent Literature 1] JP Laid-Open Publication No. 2009-136641

[Patent Literature 2] JP Utility Model Registration No. 3018130

[Patent Literature 1] JP Laid-Open Publication No. H5-220242

SUMMARY OF THE INVENTION

Problem to be Solved by the Invention

Herein, in general, in sports in association with hitting a spherical body, such as golf, in order to realize appropriate strength of the hitting the ball depending upon the situation, it is said that it is preferable to adjust swing speed and strength while a constant form of swing is maintained. However, it requires proficiency to adjust the swing speed and the strength while the constant form is maintained, and it is associated with a difficulty to common players.

For such occasions, for example, the swingweight proposed in Patent Literature 1 to Patent Literature 3 is used, but if the swingweight is mounted once, since it is troublesome to replace the swingweight and the swingweight can be mounted at a predetermined position, it cannot be stated that the swing speed and strength are easily and appropriately adjustable. In other words, a swingweight that easily and appropriately enable to adjust the swing speed and strength has been in demand.

Then, the objective of the present invention is to provide the swingweight that easily and appropriately enables to adjust the swing speed and strength depending upon the situation, and after the inventor of the present invention devoted himself to solve such problems, he has discovered that a swing with different speed and strength while a constant form is maintained if a position of the center of gravity for a golf club or a racket, etc. can be appropriately changed in the longitudinal direction depending upon the situation, and the inventor has completed the present invention.

In the golf clubs, etc. of the prior art, nothing that focuses upon the correlation between the swing speed and the position of the center of gravity, and that enables to easily and appropriately fine-adjust the position of the center of gravity toward the longitudinal direction (axial direction) of the grip; concurrently, that enables to stabilize the position of the center of gravity exists, and the adjustment of the swing speed and strength requires a certain degree of proficiency.

Specifically, in the golf club for practice described in Patent Literature 1, although it is described to mount a weight at the end of the grip side, the mount position cannot be changed appropriately in the axial direction depending upon the situation. Further, as in the golf club described in Patent Literature 2, when a weight is mounted within a hosel, a weight cannot only be easily replaced or adjusted, but the mount position of the weight cannot also be appropriately adjusted.

In addition, in the gold club disclosed in Patent Literature 3, a structure to house a weight material within a section formed within the grip is adopted, and if the fill ration of the spherical weight material is small, the spherical weight material moves within this section in association with the swing, and the position of the center of gravity becomes unstable. Further, it is possible for the position of the center of gravity at the time of swinging to be eccentrically-located at the club head side by reducing the fill ration of the weight material, but it is impossible to be eccentrically-located at the grip end side.

Thus, in the conventional golf clubs, the technical concept to adjust the swing speed by fine-adjusting the position of the center of gravity does not exist, and it is difficult to appropriately change and stabilize the position of the center of gravity depending upon the situation; therefore, the usability is not so good, as well.

Means for Solving the Problem

In order to solve the problems, the present invention provides a swingweight to be used by being inserted into a grip from a grip end and secured, having:

a support shaft that extends in the axial direction of the grip;

a weight that is mounted to the support shaft to be movable in the axial direction of the support shaft and to be securable at any position; and a securing part that is established at one end of the support shaft, and that is secured at the grip end.

The swingweight of the present invention preferably has a flanged body established at the other end of the support shaft.

In the swingweight of the present invention, the flanged body is preferably made of an elastic body.

Further, in the swingweight of the present invention, it is preferable that a male screw part is formed in at least a portion of the support shaft; a female screw is formed within the weight; and the weight is mounted by screwing together with the support shaft.

Further, in the swingweight of the present invention, the weight preferably has flanged portions at both ends.

Effect of the Invention

The swingweight of the present invention enables to adjust weight balance so as to locate the center of gravity at a desired position by changing the position to mount a weight to the support shaft. Therefore, according to the swingweight of the present invention, it becomes easy to appropriately change and stabilize the position of the center of gravity depending upon the situation or a player's convenience, and it becomes possible to easily and appropriately adjust the swing speed and strength while a constant form is easily and accurately maintained by using this swingweight for a golf club or a racket.

For the swingweight of the present invention, since a flanged body is established at the other end of the support shaft, the flanged body functions as a stopper with regard to a weight, and it can prevent the weight from separating, and on the occasion of swing, the swingweight can control the weight balance if it becomes too unstable due to the support shaft excessively oscillating within the shaft because the flanged body makes contact with the inner wall of the grip or the inner wall of the shaft extending toward the inside of the grip.

Further, in the swingweight of the present invention, since the flanged body is made of an elastic body, even if the flanged body collides against the inner wall of the grip or the inner wall of the shaft extending toward the inside of the grip on the occasion of swing, generation of collision sound or impact shock can be controlled.

In the swingweight of the present invention, since the weight is mounted to the support shaft by screwing a female screw part formed in the weight to a male screw part, it is possible to move the position of the weight along the longitudinal direction of the support shaft by turning the weight centering on the support shaft. Further, since the weight is mounted to the support shaft by screwing, even if the grip is swung for swing, a failure, such as a separation of the weight, will never occur.

In the swingweight of the present invention, since flanged portions are established at both ends of the weight, when a weight compensator, such as a lead plate, is mounted for weight adjustment (addition) of the weight, the flanged portions function as a stopper, respectively, and they can prevent the separation of the weight compensator from the weight.

MODE FOR CARRYING OUT THE INVENTION

Subsequently, as a preferred embodiment of the swingweight of the present invention including the support shaft, the weight and the securing part as essential constituents, an embodiment of the golf club having the swingweight of the present invention is explained in detail with reference to drawings.

Figure 1:
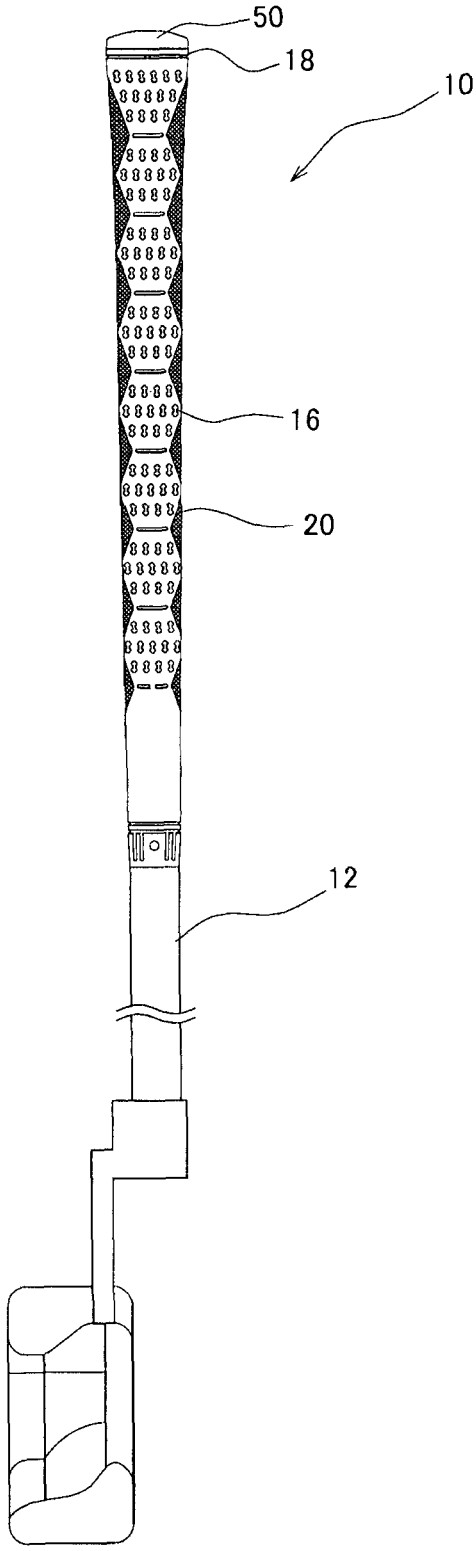
FIG. 1 is a front view showing a frame format of a golf club (putter) having the swingweight relating to one embodiment of the present invention.
Figure 4:
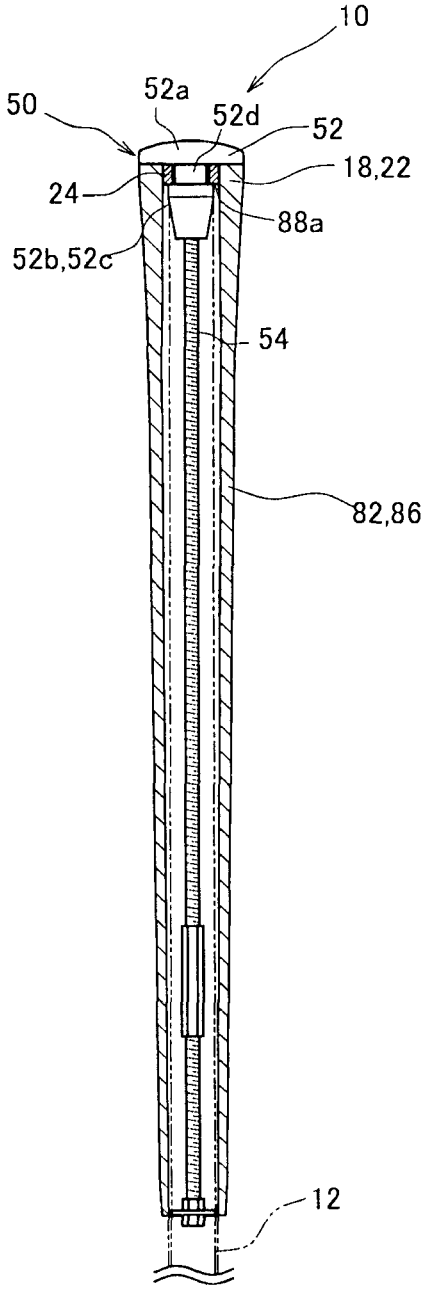
FIG. 4 is a cross-sectional view showing a structure in the vicinity of the grip of the golf club shown in FIG. 1.

As shown in FIG. 1 and FIG. 4, a golf club 10 is a putter, and a club head 14 is mounted to the end side of a shaft 12, and a swingweight 50 is inserted and secured from the end (grip end 18) side of the grip 16 established at the end side toward the inside of the grip 16. The shaft 12 is formed with a hollow shaft body as similar to the conventionally-known one, and the club head 14 is formed as similar to that in the conventionally-known putter.

The grip 16 has a grip body 20 and a connection part 22. The grip body 20 is a hollow cylindrical portion gripped by a user, and the shaft 12 is inserted from the opening portion placed at one end side. The grip body 20 is formed with a polymer material (elastomer) having rubber-like elasticity, such as rubber including natural rubber or synthetic rubber, and has elasticity.

Figure 5:
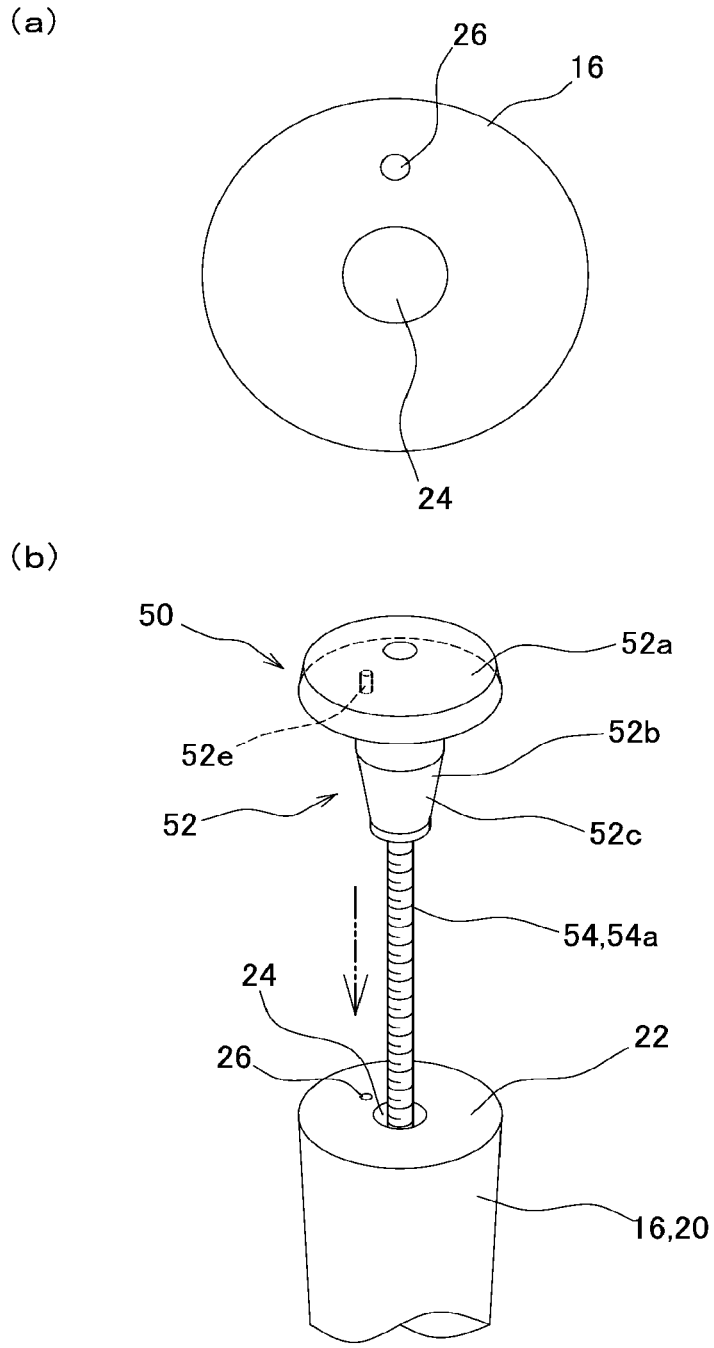
FIG. 5 (*a*) is a front view showing a connection part of the golf club shown in FIG. 1, and FIG. 5 (*b*) is a perspective view showing the state of a stage where the swingweight shown in FIG. 2 is inserted and mounted from the grip end.

As shown in FIG. 5, a connection part 22 has a disc-like (or ring-like) configuration that is placed at the grip end 18 out of the grip 16, and that has a slot 24 in the radially-substantially center, and that has a concave portion 26 in the vicinity, and closes the end portion of the grip body 20.

The disc-like portion having the slot 24 out of the connection part 22 is formed with a polymer material (elastomer) having the rubber-like elasticity as similar to the grip body 20, and is referred to as harder than the grip body 20. Consequently, the disc-like portion is more difficult to be deformed than the grip body 20, and can solidly maintain a securing part 52 of the swingweight 50 to be described later in detail to the slot 24.

The disc-like portion is pre-formed in the grip body 20, and the grip body 20 is formed by inserting the disc-like portion into a mold and by integrally molding the grip 16 into this by injection molding. The slot 24 is formed with a hole having substantially-circular opening shape, and this is a portion where an inset part 52*b* forming the securing part 52 of the swingweight 50 will be described later in detail. It is needless to say, the grip body 20 including the grip 16 and the connection part 22 can be molded with the same material without using the disc-like portion as another member.

Figure 2:
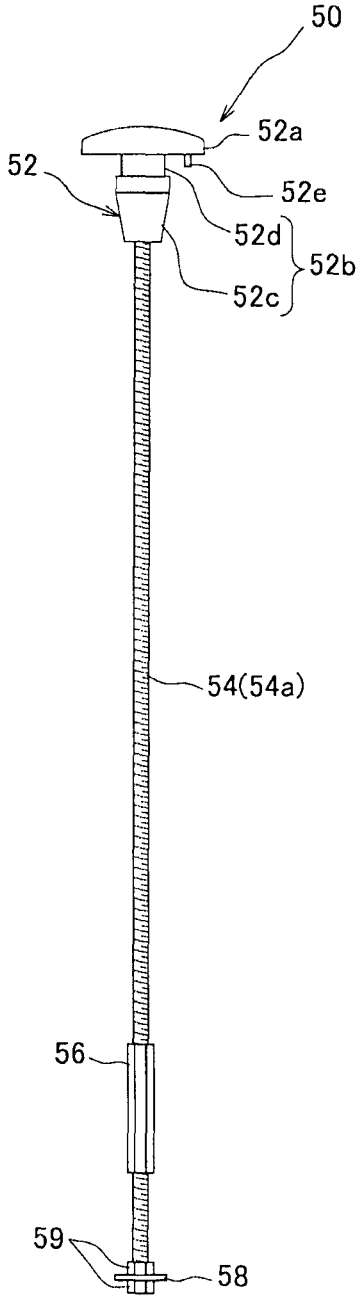
FIG. 2 is a front view showing the swingweight relating to one embodiment of the present invention.

As shown in FIG. 2 and FIG. 4, the swingweight 50 has a configuration including flanged part 58 and nuts 59 in addition to the securing part 52, the support shaft 54 and the weight 56, which are the essential constituents of the swingweight of the present invention. Hereafter, these constituents are explained.

The securing part 52 is for securing the swingweight 50 to the grip end 18, and has substantially-disc-like end part 52*a* and the inset 52*b*, and a convex part 52*e* is placed at the side of the inset part 52*b*. The substantially-disc-like end part 52*a* is a disc-like part having substantially the same diameter as the outer diameter of the grip end 18, and the front side is curved so as to gradually become convex toward the position of the shaft center, and the back side is flat.

The inset part 52*b* is a shaft-like portion vertically established in the substantially-center at the back side of the substantially-disc-like end part 52*a*. As shown in FIG. 2 and FIG. 5, the inset part 52*b* is further broadly classified into an expanded diameter part 52*c* and an engagement part 52*d*.

The expanded diameter part 52*c* has a taper portion formed so as to have the outer diameter expanding toward the proximate end side (substantially-disc-like end part 52*a* side) from the end side. In the expanded diameter part 52*c*, the outer diameter of the end portion is smaller than the opening size of the slot 24 placed in the connection part 22, but the portion at the engagement part 52*d* side is greater than the opening size of the slot 24 placed in the connection part 22 around the axially-intermediate portion. Consequently, when the securing part 52 is further pushed in the axial direction in the state where the inset part 52*b* is inserted into the slot 24, the connection part 22 is elastically deformed and the slot 24 is pushed by the expanded diameter part 52*c*.

The engagement part 52*d* is a portion positioned between the proximate part of the inset part 52*b*, i.e., the expanded diameter part 52*c* and the back side of the substantially-disc-like end part 52*a*, and engaged with the slot 24 placed in the connection part 22.

The outer diameter of the engagement part 52*d* is substantially the same as the opening side of the slot 24 or greater.

According to such configuration, in the inset part 52*b*, the outer diameter is drastically changed around the boundary between the expanded diameter part 52*c* and the engagement part 52*d*, and a step is formed between both members, and this step portion (surface) is extending toward the substantially vertical direction with regard to the axial direction of the support shaft 54. In other words, the normal direction of the step surface is substantially parallel to the axial direction of the support shaft 54. Further, the axial length of the engagement part 52*d* is substantially the same as the thickness of the connection part 22.

Consequently, when the inset part 52*b* is pushed into the slot 24 and the engagement part 52*d* is engaged with the slot 24, the step sticks mentioned above sticks in the connection 22, and the back side of the substantially-disc-like end part 52*a* and the connection part 22 are substantially adhered. With this design, the swingweight 50 is absolutely secured to the grip 16 by the securing part 52.

In addition, when the inset part 52*b* is pushed until the engagement part 52*d* reaches the slot 24, because frictional force acting on the occasion that the expanded diameter part 52*c* passes through the slot 24 is released and the engagement part 52*d* is engaged, a user can obtain an appropriate sense of moderation on the occasion of engagement and a sensation where the swingweight 50 is firmly secured can be provided to the user. Further, in the present embodiment, since the connection part 22 is formed with a harder material than that of the grip 16, the connection strength on the occasion of connecting the swingweight 50 is high.

A convex part 52*e* is a protrusion portion that is present in the vicinity of the inset part 52*b* as described above, and that protrudes from the back side of the substantially-disc-like upper end part 52*a*. The convex part 52*e* is fitted into the concave portion 26 placed in the connection part 22 of the grip end 18 on the occasion of mounting the swingweight 50 in the golf club 10 for preventing the rotation of the swingweight 50 around the shaft center.

The support shaft 54 is a shaft body that is inserted from the slot 24 formed in the grip end 18 for supporting (securing) the weight 45 to be described in detail. The support shaft 54 is formed with a screw shaft where the male screw 54*a* is substantially throughout the entire body. When the swingweight 50 is mounted to the grip end 18, the support shaft 54 becomes in the state to be linearly extending inside the grip 16.

This support shaft 54 can be any length, but it is preferable that the support shaft 54 is, for example, substantially the same as or longer than the grip 16 in order to certainly enable the swing with different speed and strength while a constant form is maintained by appropriately changing the position of the center of gravity toward the longitudinal direction.

Figure 3:
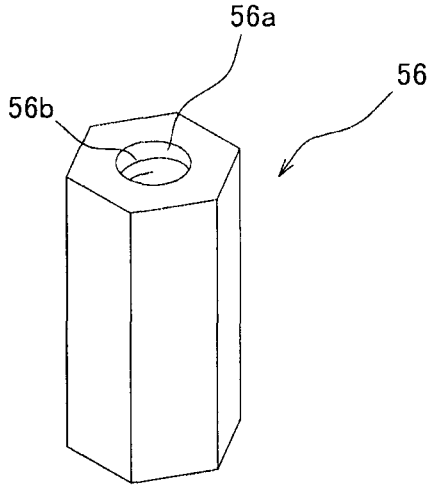
FIG. 3 (*a*) is a perspective view showing a weight adopted in the swingweight shown in FIG. 2, and FIG. 3 (*b*) is a perspective view showing the flanged portion.
Figure 3:
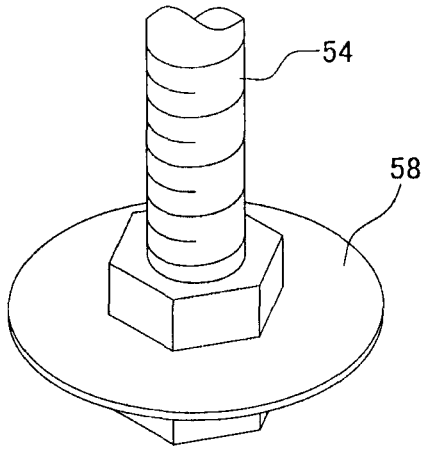

The weight 56 is to be mounted to the support shaft 54, and has a nut-like structure where the female 56*b* is formed within a through-hole 56*a* formed in the center as shown in FIG. 3 (*a*). The weight 56 is mounted to the support shaft 54 by screwing the female screw 56*b* with the male screw 54*a* formed in the support shaft 54.

Consequently, it is possible for the weight 56 to be moved along the axial direction of the support shaft 54 by turning around the shaft center and to be secured at any position. In the present embodiment, one weight 56 are mounted to the support shaft 54.

As shown in FIG. 2 and FIG. 3 (*b*), the flanged body 58 is secured to the other end side of the support shaft 54, i.e., at the opposite side from the securing part 52. The flanged body 58 is formed with a material having flexibility and elasticity, such as rubber, and the size of the outer diameter is the same as or greater than the inner diameter of the shaft extending inside the grip 16.

Consequently, if the swingweight 50 is inserted into the slot 24 from the grip end 18 side with the flanged body 58 in the lead, the flanged body 58 is appropriately deformed so as to be matched with the slot 24 and the shaft 12, and the flanged body 58 makes substantially close contact with the inner wall surface of the shaft 12.

Therefore, when the securing part 52 is connected (secured) with/to the connection part 22 placed in the grip end 18, both ends of the support shaft 54 are supported by the securing part 52 and the flanged body 58 as shown in FIG. 2, and even if oscillation is added in association with the swing, etc., a problem, such as the support shaft 54 being excessively wiggling the support shaft 54 within the shaft 12 or the support shaft 54 or the weight 56 colliding against the inner wall surface of the grip 16, will never occur.

In the golf club 10 of the present embodiment, the position of the weight 56 is moved and changed in the axial direction (longitudinal direction) of the grip 16 by appropriately removing the swingweight 50 and turning the weight 56 centering on the support shaft 54, and centrifugal force acting on the occasion of swinging under the same condition can be adjusted.

Specifically, the centrifugal force acting on the occasion of swinging becomes greater by moving the weight 56 downward, i.e., to the position at the side of the club head 14 and securing it at that position, and speed and strength of swing and hitting the ball can be improved. In the meantime, the centrifugal force acting at the time of swinging is diminished by moving the weight 56 upward, i.e., to the position at the side of the grip end 18 and securing it at that position, and strength of hitting the ball can be weakened.

Therefore, for example, the swing speed and strength on the occasion of swinging under the same conditions can be easily and accurately adjusted by the weight balance using the swingweight 50 depending upon, for example, the easiness of run-on-the-ball on a putting green (how fast the green is).

In the swingweight 50 of the present embodiment, the flanged body 58 is placed at the other end side (the club head 14 side) of the support shaft 54 in the state of being interposed by two nuts 59, and these members function as stoppers for preventing the separation of the weight 56. Further, since the flanged body 58 is made of an elastic body, even if oscillation is added in association with swing, a collision sound between the grip 16, the shaft 12, etc. and the flanged body 58 or an impact in association with the collision hardly occurs.

In addition, since the outer diameter of the flanged body 58 is greater than the inner diameter of the shaft 12 within the grip 16, the flanged body 58 is elastically deformed and comes into contact so as to have the flanged body 58 fitting the inner wall of the shaft 12 on the occasion of inserting the swingweight 50 into the grip 16 and the shaft 12. With this deformation, the support shaft 54 is supported at both ends by the securing part 52 and the flanged body 58, and even if swing is performed, the swingweight 50 does not wiggle within the shaft 12.

Therefore, any failures, such as a subtle change of the position of center of gravity due to the waggle of the weight 56 or generation of collision sound between the weight 56 or the support shaft 54 and the grip 16 or the shaft, will never occur to the golf club 10.

In the swingweight 50 of the present embodiment, the weight 56 is mounted to the support shaft 54 by screwing the female screw 56*b* formed within the through-hole 56*a* of the weight 56 into the male screw 54*a* formed in the support shaft 54, and the mounting position of the weight 56 can be moved by turning the weight 56.

Further, since pitches of the male screw 54*a* and the female screw 56*b* are constant, respectively, the travel distance of the weight 56 in the axial direction can be adjusted according to a rotational distance of the weight 56, and the mounting position of the weight can be easily and accurately adjusted. In addition, since the weight 56 is mounted to the support shaft 54 by screwing, even if the grip 15 portion is wiggled for swing, a fault, such as separation of the weight, will never occur.

Thus, the typical embodiment of the present invention has been explained, but the design is variously modifiable within the scope of the technical concept of the present invention described in the claims, and these are all included in the present invention.

For example, in the present embodiment, the case where the securing part 52 has the specific structure shown in FIG. 2, etc. was explained, but since the characteristic of the present invention is to enable to easily and accurately adjust the position of the center of gravity to be by moving the weight 52 in the support shaft 54, the securing part can have any configuration as long as the support shaft having the weight can be secured to the grip.

Further, in the embodiment, the example where one weight 56 is placed is exemplified, but the present invention shall not be limited to this, but two or more weights 56 can be mounted. Further, the weight 56 may have various shapes.

Further, in the present embodiment, the example where the support shaft 54 is bolt-like and the weight is nut-like is exemplified, but the present invention shall not be limited and a configuration where the weight 56 is mounted to the support shaft 54 not having the male screw 54*a* by a securing means, such as a clip is also acceptable.

Further, the swingweight 50 in the present embodiment where a lead plate, etc. is mounted to the weight 56 and the weight as the entire weight 56 may be adjustable. In other words, the swingweight 50 may have a configuration where a weight adding member, such as a lead plate, is mountable in order to increase the weight of the weight 56. With this configuration, a scope of control of the swingweight is expandable.

Figure 6:
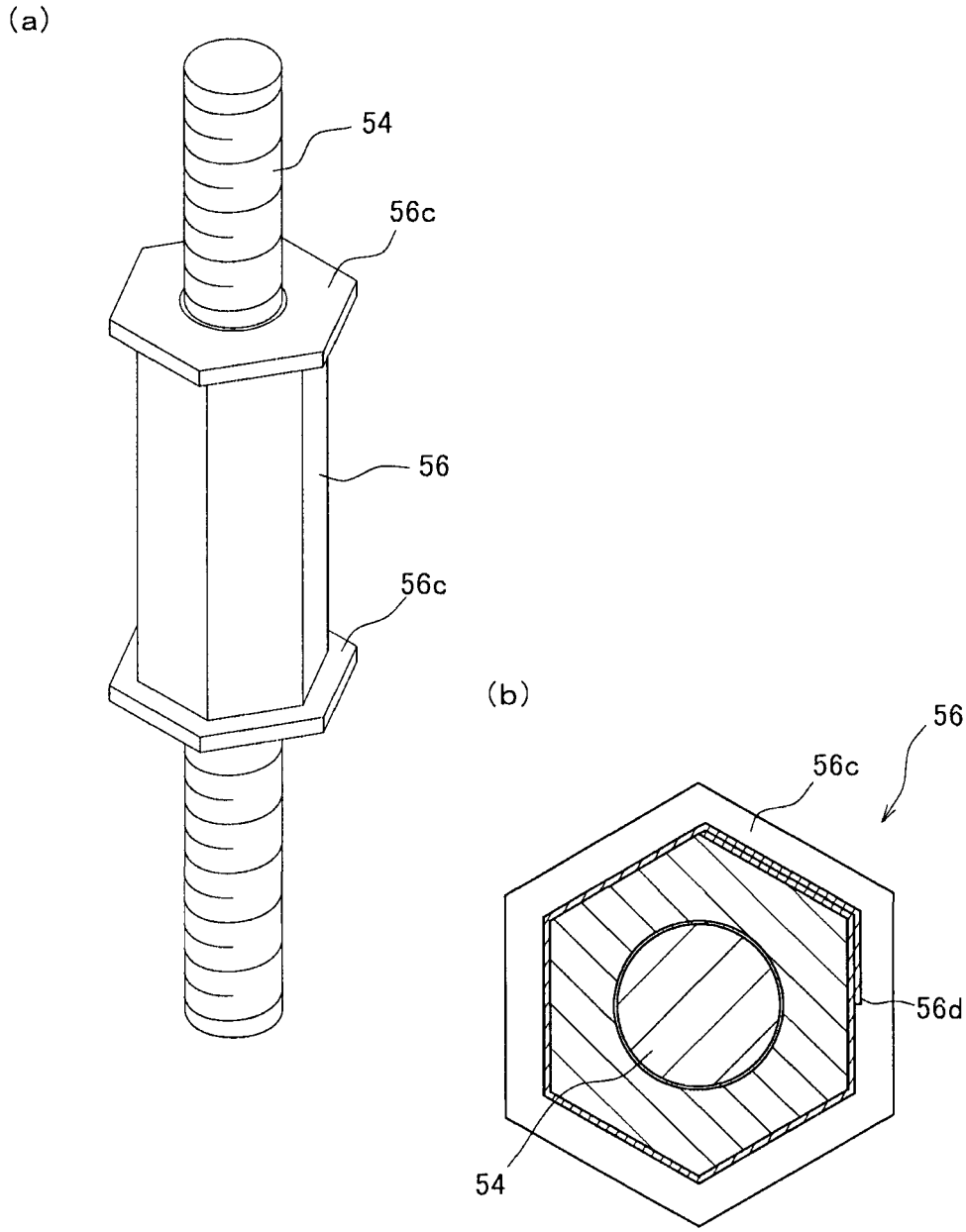
FIG. 6 (*a*) is a perspective view showing a modification example of the weight, and FIG. 6 (*b*) is a cross-sectional view showing a state where the weight adding member is mounted to the weight shown in FIG. 6 (*a*).

For example, as shown in FIG. 6, when the weight adding member 56*d*, such as a lead plate, flanged portions are established at the upper end and the lower end of the weight 56, and the weight adding member 56*d* can be mounted between them from separating. In FIG. 6, although the shape of the flanged portion is substantially hexagonal, this can be other polygonal or substantially-circle shape.

Further, swingweight 50 does not include scales indicating the mounting position of the weight 56, but the scales indicating the mounting position of the weight 56 or markers indicating an outline of the mounting position may be included. Such configuration enables to easily and accurately understand the mounting position of the weight 56, and to further accurately adjust the mounting position according to swing speed or speed of ball hit.

The golf club 10 of the present embodiment is a putter, but the present invention shall not be limited to this, but the golf club 10 is another type, such as a driver or an iron club.

Further, each constituent of the swingweight 50 can be formed with various materials, but in general, for example, the securing part 52 is made of a synthetic resin, such as a hard resin, and the support shaft 54 and the weight 56 are made of metal. It is needless to say, the swingweight 50 is not limited to this configuration, but the weight 56 may be made of metal and the securing part 52 and the support shaft 54 may be made of a synthetic resin, such as a hard resin.

INDUSTRIAL AVAILABILITY

The swingweight of the present invention is applicable to all articles having a grip, such as a golf club or a tennis racket, and since the position of the center of gravity can be easily and appropriately adjusted in the article having the swingweight of the present invention, swing speed or speed of hitting a ball depending upon the situation can be obtained by a constant swing.

The invention claimed is:

1. A swingweight, comprising:

a support shaft;

a weight mounted to the support shaft, said weight configured to be movable in the axial direction of the support shaft and to be securable at any position on the support shaft; and a securing part located at a first end of the support shaft, said securing part comprising a substantially disc-like end part, an inset part, and a convex part located at the side of the inset part, wherein said swingweight is configured to be inserted into a grip end of a golf club having a hollow shaft, said securing part is configured to secure said swingweight to the grip end of the golf club, the substantially disc-like end part is adhered on the grip end, and the convex part is configured to fit into the grip end when the securing part is secured at the grip end.

2. The swingweight according to claim 1, comprising:

a flanged body secured to a second end of the support shaft, wherein said second end is opposite the first end in an axial direction of the support shaft.

3. The swingweight according to claim 2, wherein the flanged body is made of an elastic body.

4. The swingweight according to claim 1, wherein the weight has flanged portions at both ends.

* * * * *